US010062390B2

(12) United States Patent
Nagel et al.

(10) Patent No.: US 10,062,390 B2
(45) **Date of Patent: *Aug. 28, 2018**

(54) DECODER FOR GENERATING A FREQUENCY ENHANCED AUDIO SIGNAL, METHOD OF DECODING, ENCODER FOR GENERATING AN ENCODED SIGNAL AND METHOD OF ENCODING USING COMPACT SELECTION SIDE INFORMATION

(71) Applicant: Fraunhofer-Gesellschaft zur Foerderung der angewandten Forschung e.V., Munich (DE)

(72) Inventors: Frederik Nagel, Nuremberg (DE); Sascha Disch, Fuerth (DE); Andreas Niedermeier, Munich (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/668,375

(22) Filed: Aug. 3, 2017

(65) Prior Publication Data

US 2017/0358311 A1 Dec. 14, 2017

Related U.S. Application Data

(63) Continuation of application No. 14/811,722, filed on Jul. 28, 2015, which is a continuation of application No. PCT/EP2014/051591, filed on Jan. 28, 2014.
(Continued)

(51) Int. Cl.
*G10L 19/00* (2013.01)
*G10L 19/26* (2013.01)
(Continued)

(52) U.S. Cl.
CPC ..... *G10L 19/265* (2013.01); *G10L 19/002* (2013.01); *G10L 21/0388* (2013.01)

(58) Field of Classification Search
CPC ..... G10L 19/00
(Continued)

(56) References Cited

U.S. PATENT DOCUMENTS 7,751,572 B2 * 7/2010 Villemoes ..... G10L 19/008 381/22
8,275,626 B2 9/2012 Neuendorf et al.
(Continued)

FOREIGN PATENT DOCUMENTS

CN 102027537 A 4/2011
CN 102089814 A 6/2011
(Continued)

OTHER PUBLICATIONS

Bauer, P. et al., "A Statistical Framework for Artificial Bandwidth Extension Exploiting Speech Waveform and Phonetic Transcription", retrieved online on Apr. 2, 2014 from url: http://www.researchgate.net/publication/228336475_A_Statistical_Framework_for_Artificail_Bandwidth_Extension_Exploiting_Speech_Waveform_and_Phonetic_Transcription/file/e0b495225068409423.pdf, Jan. 2009, 6 pages.
(Continued)

*Primary Examiner* — Michael Colucci
(74) *Attorney, Agent, or Firm* — Perkins Coie LLP; Michael A. Glenn

(57) ABSTRACT

A decoder for generating a frequency enhanced audio signal, includes: a feature extractor for extracting a feature from a core signal; a side information extractor for extracting a selection side information associated with the core signal; a parameter generator for generating a parametric representation for estimating a spectral range of the frequency
(Continued)

enhanced audio signal not defined by the core signal, wherein the parameter generator is configured to provide a number of parametric representation alternatives in response to the feature, and wherein the parameter generator is configured to select one of the parametric representation alternatives as the parametric representation in response to the selection side information; and a signal estimator for estimating the frequency enhanced audio signal using the parametric representation selected.

17 Claims, 13 Drawing Sheets

Related U.S. Application Data

(60) Provisional application No. 61/758,092, filed on Jan. 29, 2013.

(51) Int. Cl.
*G10L 21/0388* (2013.01)
*G10L 19/002* (2013.01)

(58) Field of Classification Search
USPC ..... 704/500, 200.1, 205; 381/23; 714/701
See application file for complete search history.

(56) References Cited

U.S. PATENT DOCUMENTS

| | | | | |
|---|---|---|---|---|
| 8,484,020 | B2 | 7/2013 | Krishnan et al. | |
| 8,731,950 | B2 | 5/2014 | Herre et al. | |
| 8,929,558 | B2 * | 1/2015 | Engdegard | G10L 19/008 381/10 |
| 9,094,754 | B2 * | 7/2015 | Engdegard | G10L 19/008 |
| 9,191,045 | B2 * | 11/2015 | Purnhagen | G10L 19/008 |
| 2006/0140412 | A1 * | 6/2006 | Villemoes | G10L 19/008 381/12 |
| 2007/0019813 | A1 * | 1/2007 | Hilpert | G10L 19/008 381/22 |
| 2007/0094027 | A1 | 4/2007 | Vasilache | |
| 2007/0208557 | A1 * | 9/2007 | Li | G10L 19/04 704/200.1 |
| 2007/0255572 | A1 | 11/2007 | Miyasaka et al. | |
| 2008/0154583 | A1 * | 6/2008 | Goto | G10L 19/008 704/205 |
| 2009/0282298 | A1 * | 11/2009 | Zopf | G10L 19/005 714/701 |
| 2010/0046762 | A1 * | 2/2010 | Henn | G10L 21/038 381/23 |
| 2010/0080397 | A1 | 4/2010 | Suzuki et al. | |
| 2011/0004479 | A1 * | 1/2011 | Ekstrand | G10L 19/022 704/500 |
| 2011/0054885 | A1 | 3/2011 | Nagel et al. | |
| 2011/0173006 | A1 | 7/2011 | Nagel et al. | |
| 2011/0202353 | A1 * | 8/2011 | Neuendorf | G10L 19/20 704/500 |
| 2012/0002818 | A1 * | 1/2012 | Heiko | G10L 19/008 381/22 |
| 2012/0263308 | A1 | 10/2012 | Herre et al. | |
| 2013/0121411 | A1 * | 5/2013 | Robillard | G10L 19/008 375/240.12 |
| 2013/0170391 | A1 * | 7/2013 | Feiten | H04L 41/069 370/252 |

FOREIGN PATENT DOCUMENTS

| | | | |
|---|---|---|---|
| CN | 102177545 | A | 9/2011 |
| CN | 102714035 | A | 10/2012 |
| EP | 0720148 | A1 | 7/1996 |
| EP | 2239732 | A1 | 10/2010 |
| JP | 2007328268 | A | 12/2007 |
| RU | 2455710 | C2 | 7/2012 |
| RU | 2011101616 | A | 7/2012 |
| TW | 201009808 | A | 3/2010 |
| TW | 201104674 | A | 2/2011 |
| TW | 201140563 | A | 11/2011 |
| WO | 2010115845 | A1 | 10/2010 |
| WO | 2011047886 | A1 | 4/2011 |

OTHER PUBLICATIONS

Bessette, Bruno et al., "The Adaptive Multirate Wideband Speech Codec (AMR-WB)", IEEE Transactions on Speech and Audio Processing, vol. 10, No. 8, Nov. 8, 2002, pp. 620-636.

Geiser, B et al., "Bandwidth Extension for Hierarchical Speech and Audio Coding in ITU-T Rec. G.729.1", IEEE Transactions on Audio, Speech and Language Processing, IEEE Service Center, vol. 15, No. 8, Nov. 2007, pp. 2496-2509.

Geiser, B. et al., "Robust Wideband Enhancement of Speech by Combined Coding and Artificial Bandwidth Extension", Proceedings of IWAENC; Eindhoven, Netherlands, Sep. 15, 2005, pp. 21-24.

Iser, Bernd et al., "Bandwidth Extension of Speech Signals", Springer Science + Business Media, LLC, 2008, pp. 53-66.

Jari, Makinen et al., "A MR-WB+: A New Audio Coding Standard for 3rd Generation Mobile Audio Services", Multimedia Technologies Lasboratory Nokia Research Center, Finland. VoiceAge Corp., Montreal, Qc, Canada. University of Sherbrooke, Qc, Canada. Multimedia Technologies, Ericsson Research, Sweden., Mar. 2005, pp. II-1109-II-1112.

Jelinek, Milan , "Wideband Speech Coding Advances in VMR-WB Standard", IEEE Transactions on Audio, Speech, and Language Processing, vol. 15, No. 4,, May 4, 2007, pp. 1167-1179.

Katsir, I et al., "Speech Bandwidth Extension Based on Speech Phonetic Content and Speaker Vocal Tract Shape Estimation", in Proc. EUSIPCO 2011, Barcelona, Spain, Aug. 29-Sep. 2, 2011, pp. 461-465.

Larsen, Erik et al., "Audio Bandwidth Extension", Application of Psychoacoustics, Signal Processing and Loudspeaker Design, Joh Wiley& Sons Ltd, The Atrium, Southern Gate, Chichester, West Sussex PO19 8SQ, 2004, pp. 171-236.

Miao, Lei, "G711.1 Annex D and G.722 Annex B—New ITU-T Superwideband Codecs", In the proceedings of ICASSP; Prague, Czech Republic, May 2011, pp. 5232-5235.

Neuendorf, M et al., "MPEG Unified Speech and Audio Coding—The ISO/MPEG Standard for High-Efficiency Audio Coding of all Content Types", Audio Engineering Society Convention Paper 8654, Presented at the 132nd Convention, Apr. 26-29, 2012, pp. 1-22.

Pulakka, Hannu et al., "Bandwidth Extension of Telephone Speech Using a Neutral Network and a Filter Bank Implementation for Highband Mel Spectrum", IEEE Transactions on Audio, Speech, and Language Processing, vol. 19, No. 7, Sep. 7, 2011, pp. 2170-2183.

Sanna, M. et al., "A codebook design method for fricative enhancement in Artificial Bandwidth Extension", Proceedings of the 5th Int'l Mobile Multimedia Communications Conference, London, UK, Sep. 9, 2009, 7 pages.

Vaillancourt, T et al., "ITU-T EV-VBR: A Robust 8-32 kbit/s Scalable Coder for Error Prone Telecommunications Channels", in Proc. EUSIPCO 2008, Lausanne, Switzerland, Aug. 2008, 5 pages.

* cited by examiner

| no. of bits of sel. side info | no. of param. repres. alt. (maxi.) |
|---|---|
| 1 | 2 |
| 2 | 4 |
| 3 | 8 |
| 4 | 16 |
| 5 | 32 |

DECODER FOR GENERATING A FREQUENCY ENHANCED AUDIO SIGNAL, METHOD OF DECODING, ENCODER FOR GENERATING AN ENCODED SIGNAL AND METHOD OF ENCODING USING COMPACT SELECTION SIDE INFORMATION

CROSS-REFERENCE TO RELATED APPLICATIONS

This application is a continuation of copending U.S. patent application Ser. No. 14/811,722, filed Jul. 28, 2015, which is a continuation of International Application No. PCT/EP2014/051591, filed Jan. 28, 2014, which is incorporated herein by reference in its entirety, and additionally claims priority from U.S. Application No. 61/758,092, filed Jan. 29, 2013, which is also incorporated herein by reference in its entirety.

BACKGROUND OF THE INVENTION

The present invention is related to audio coding and, particularly to audio coding in the context of frequency enhancement, i.e., that a decoder output signal has a higher number of frequency bands compared to an encoded signal. Such procedures comprise bandwidth extension, spectral replication or intelligent gap filling.

Contemporary speech coding systems are capable of encoding wideband (WB) digital audio content, that is, signals with frequencies of up to 7-8 kHz, at bitrates as low as 6 kbit/s. The most widely discussed examples are the ITU-T recommendations G.722.2 [1] as well as the more recently developed G.718 [4, 10] and MPEG-D Unified Speech and Audio Coding (USAC) [8]. Both, G.722.2, also known as AMR-WB, and G.718 employ bandwidth extension (BWE) techniques between 6.4 and 7 kHz to allow the underlying ACELP core-coder to "focus" on the perceptually more relevant lower frequencies (particularly the ones at which the human auditory system is phase-sensitive), and thereby achieve sufficient quality especially at very low bitrates. In the USAC eXtended High Efficiency Advanced Audio Coding (xHE-AAC) profile, enhanced spectral band replication (eSBR) is used for extending the audio bandwidth beyond the core-coder bandwidth which is typically below 6 kHz at 16 kbit/s. Current state-of-the-art BWE processes can generally be divided into two conceptual approaches:

- Blind or artificial BWE, in which high-frequency (HF) components are reconstructed from the decoded low-frequency (LF) core-coder signal alone, i.e. without requiring side information transmitted from the encoder. This scheme is used by AMR-WB and G.718 at 16 kbit/s and below, as well as some backward-compatible BWE post-processors operating on traditional narrowband telephonic speech [5, 9, 12] (Example: FIG. 15).
- Guided BWE, which differs from blind BWE in that some of the parameters used for HF content reconstruction are transmitted to the decoder as side information instead of being estimated from the decoded core signal. AMR-WB, G.718, xHE-AAC, as well as some other codecs [2, 7, 11] use this approach, but not at very low bitrates (FIG. 16).

FIG. 15 illustrates such a blind or artificial bandwidth extension as described in the publication Bernd Geiser, Peter Jax, and Peter Vary: "ROBUST WIDEBAND ENHANCEMENT OF SPEECH BY COMBINED CODING AND ARTIFICIAL BANDWIDTH EXTENSION", Proceedings of International Workshop on Acoustic Echo and Noise Control (IWAENC), 2005. The stand-alone bandwidth extension algorithm illustrated in FIG. 15 comprises an interpolation procedure 1500, an analysis filter 1600, an excitation extension 1700, a synthesis filter 1800, a feature extraction procedure 1510, an envelope estimation procedure 1520 and a statistic model 1530. After an interpolation of the narrowband signal to a wideband sample rate, a feature vector is computed. Then, by means of a pre-trained statistical hidden Markov model (HMM), an estimate for the wideband spectral envelope is determined in terms of linear prediction (LP) coefficients. These wideband coefficients are used for analysis filtering of the interpolated narrowband signal. After the extension of the resulting excitation, an inverse synthesis filter is applied. The choice of an excitation extension which does not alter the narrowband is transparent with respect to the narrowband components.

FIG. 16 illustrates a bandwidth extension with side information as described in the above mentioned publication, the bandwidth extension comprising a telephone bandpass 1620, a side information extraction block 1610, a (joint) encoder 1630, a decoder 1640 and a bandwidth extension block 1650. This system for wideband enhancement of an error band speech signal by combined coding and bandwidth extension is illustrated in FIG. 16. At the transmitting terminal, the highband spectral envelope of the wideband input signal is analyzed and the side information is determined. The resulting message m is encoded either separately or jointly with the narrowband speech signal. At the receiver, the decoder side information is used to support the estimation of the wideband envelope within the bandwidth extension algorithm. The message m is obtained by several procedures. A spectral representation of frequencies from 3.4 kHz to 7 kHz is extracted from the wideband signal available only at the sending side.

This subband envelope is computed by selective linear prediction, i.e., computation of the wideband power spectrum followed by an IDFT of its upper band components and the subsequent Levinson-Durbin recursion of order 8. The resulting subband LPC coefficients are converted into the cepstral domain and are finally quantized by a vector quantizer with a codebook of size $M=2^N$. For a frame length of 20 ms, this results in a side information data rate of 300 bit/s. A combined estimation approach extends a calculation of a posteriori probabilities and reintroduces dependences on the narrowband feature. Thus, an improved form of error concealment is obtained which utilizes more than one source of information for its parameter estimation.

A certain quality dilemma in WB codecs can be observed at low bitrates, typically below 10 kbit/s. On the one hand, such rates are already too low to justify the transmission of even moderate amounts of BWE data, ruling out typical guided BWE systems with 1 kbit/s or more of side information. On the other hand, a feasible blind BWE is found to sound significantly worse on at least some types of speech or music material due to the inability of proper parameter prediction from the core signal. This is particularly true for some vocal sound such as fricatives with low correlation between HF and LF. It is therefore desirable to reduce the side information rate of a guided BWE scheme to a level far below 1 kbit/s, which would allow its adoption even in very-low-bitrate coding.

Manifold BWE approaches have been documented in recent years [1-10]. In general, all of these are either fully blind or fully guided at a given operating point, regardless of the instantaneous characteristics of the input signal.

Furthermore, many blind BWE systems [1, 3, 4, 5, 9, 10] are optimized particularly for speech signals rather than for music and may therefore yield non satisfactory results for music. Finally, most of the BWE realizations are relatively computationally complex, employing Fourier transforms, LPC filter computations, or vector quantization of the side information (Predictive Vector Coding in MPEG-D USAC [8]). This can be a disadvantage in the adoption of new coding technology in mobile telecommunication markets, given that the majority of mobile devices provide very limited computational power and battery capacity.

An approach which extends blind BWE by small side information is presented in [12] and is illustrated in FIG. 16. The side information "m", however, is limited to the transmission of a spectral envelope of the bandwidth extended frequency range.

A further problem of the procedure illustrated in FIG. 16 is the very complicated way of envelope estimation using the lowband feature on the one hand and the additional envelope side information on the other hand. Both inputs, i.e., the lowband feature and the additional highband envelope influence the statistical model. This results in a complicated decoder-side implementation which is particularly problematic for mobile devices due to the increased power consumption. Furthermore, the statistical model is even more difficult to update due to the fact that it is not only influenced by the additional highband envelope data.

SUMMARY

According to an embodiment, a decoder for generating a frequency enhanced audio signal may have: a feature extractor for extracting a feature from a core signal; a side information extractor for extracting a selection side information associated with the core signal; a parameter generator for generating a parametric representation for estimating a spectral range of the frequency enhanced audio signal not defined by the core signal, wherein the parameter generator is configured to provide a number of parametric representation alternatives in response to the feature, and wherein the parameter generator is configured to select one of the parametric representation alternatives as the parametric representation in response to the selection side information; and a signal estimator for estimating the frequency enhanced audio signal using the parametric representation selected.

According to another embodiment, an encoder for generating an encoded signal may have: a core encoder for encoding an original signal to acquire an encoded audio signal including information on a smaller number of frequency bands compared to an original signal; a selection side information generator for generating selection side information indicating a defined parametric representation alternative provided by a statistical model in response to a feature extracted from the original signal or from the encoded audio signal or from a decoded version of the encoded audio signal; and an output interface for outputting the encoded signal, the encoded signal including the encoded audio signal and the selection side information.

According to another embodiment, a method for generating a frequency enhanced audio signal may have the steps of: extracting a feature from a core signal; extracting a selection side information associated with the core signal; generating a parametric representation for estimating a spectral range of the frequency enhanced audio signal not defined by the core signal, wherein a number of parametric representation alternatives is provided in response to the feature, and wherein one of the parametric representation alternatives is selected as the parametric representation in response to the selection side information; and estimating the frequency enhanced audio signal using the parametric representation selected.

According to another embodiment, a method of generating an encoded signal may have the steps of: encoding an original signal to acquire an encoded audio signal including information on a smaller number of frequency bands compared to an original signal; generating selection side information indicating a defined parametric representation alternative provided by a statistical model in response to a feature extracted from the original signal or from the encoded audio signal or from a decoded version of the encoded audio signal; and outputting the encoded signal, the encoded signal including the encoded audio signal and the selection side information.

Another embodiment may have a computer program for performing, when running on a computer or a processor, the method of claim 20.

Another embodiment may have a computer program for performing, when running on a computer or a processor, the method of claim 21.

According to another embodiment, an encoded signal may have: an encoded audio signal; and selection side information indicating a defined parametric representation alternative provided by a statistical model in response to a feature extracted from an original signal or from the encoded audio signal or from a decoded version of the encoded audio signal.

The present invention is based on the finding that in order to even more reduce the amount of side information and, additionally, in order to make a whole encoder/decoder not overly complex, the conventional-technology parametric encoding of a highband portion has to be replaced or at least enhanced by selection side information actually relating to the statistical model used together with a feature extractor on a frequency enhancement decoder. Due to the fact that the feature extraction in combination with a statistical model provide parametric representation alternatives which have ambiguities specifically for certain speech portions, it has been found that actually controlling the statistical model within a parameter generator on the decoder-side, which of the provided alternatives would be the best one, is superior to actually parametrically coding a certain characteristic of the signal specifically in very low bitrate applications where the side information for the bandwidth extension is limited.

Thus, a blind BWE is improved, which exploits a source model for the coded signal, by extension with small additional side information, particularly if the signal itself does not allow for a reconstruction of the HF content at an acceptable perceptual quality level. The procedure therefore combines the parameters of the source model, which are generated from coded core-coder content, by extra information. This is advantageous particularly to enhance the perceptual quality of sounds which are difficult to code within such a source model. Such sounds typically exhibit a low correlation between HF and LF content.

The present invention addresses the problems of conventional BWE in very-low-bitrate audio coding and the shortcomings of the existing, state-of-the-art BWE techniques. A solution to the above described quality dilemma is provided by proposing a minimally guided BWE as a signal-adaptive combination of a blind and a guided BWE. The inventive BWE adds some small side information to the signal that allows for a further discrimination of otherwise problematic coded sounds. In speech coding, this particularly applies for sibilants or fricatives.

It was found that, in WB codecs, the spectral envelope of the HF region above the core-coder region represents the most critical data that may be used for performing BWE with acceptable perceptual quality. All other parameters, such as spectral fine-structure and temporal envelope, can often be derived from the decoded core signal quite accurately or are of little perceptual importance. Fricatives, however, often lack a proper reproduction in the BWE signal. Side information may therefore include additional information distinguishing between different sibilants or fricatives such as "f", "5", "ch" and "sh".

Other problematic acoustical information for bandwidth extension, when there occur plosives or affricates such as "t" or "tsch".

The present invention allows to only use this side information and actually to transmit this side information where it is useful and to not transmit this side information, when there is no expected ambiguity in the statistical model.

Furthermore, advantageous embodiments of the present invention only use a very small amount of side information such as three or less bits per frame, a combined voice activity detection/speech/non-speech detection for controlling a signal estimator, different statistical models determined by a signal classifier or parametric representation alternatives not only referring to an envelope estimation but also referring to other bandwidth extension tools or the improvement of bandwidth extension parameters or the addition of new parameters to already existing and actually transmitted bandwidth extension parameters.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
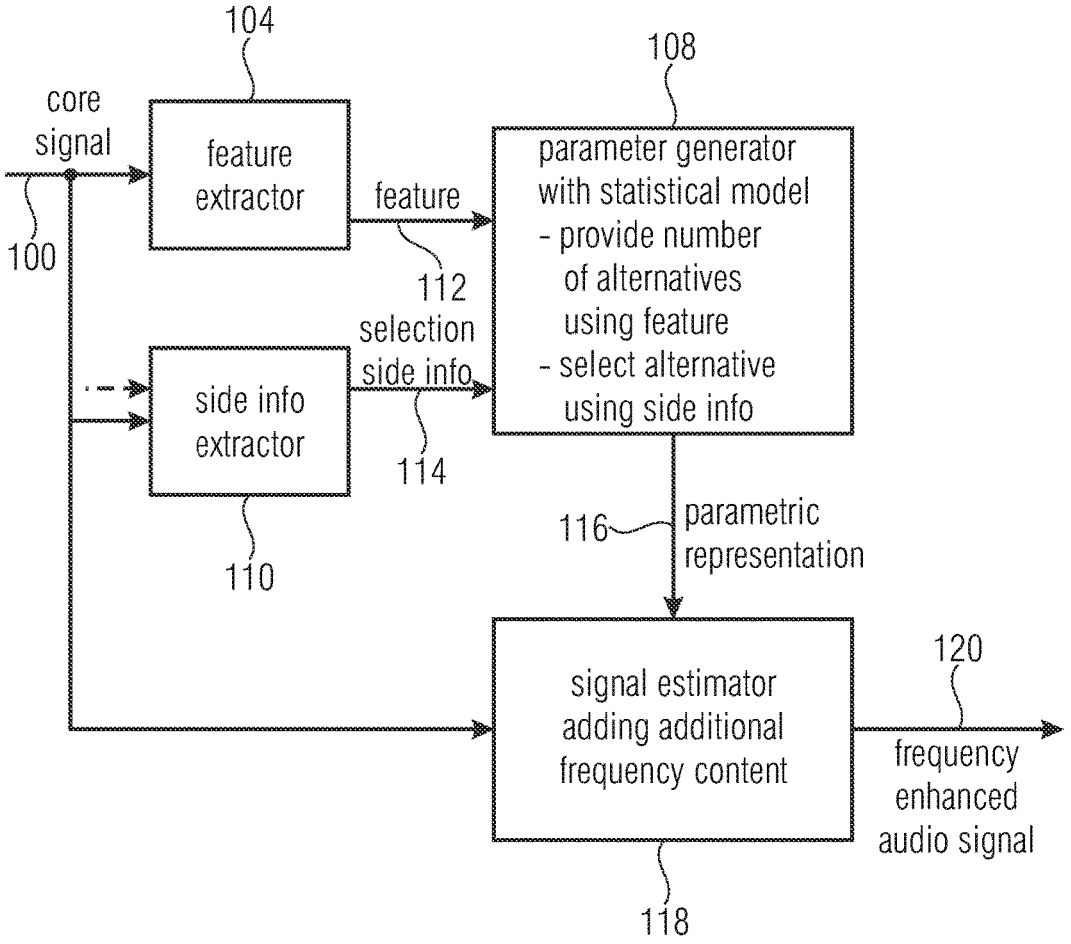
FIG. 1 illustrates a decoder for generating a frequency enhanced audio signal.

FIG. 1 illustrates a decoder for generating a frequency enhanced audio signal 120. The decoder comprises a feature extractor 104 for extracting (at least) a feature from a core signal 100. Generally, the feature extractor may extract a single feature or a plurality of feature, i.e., two or more features, and it is even advantageous that a plurality of features are extracted by the feature extractor. This applies not only to the feature extractor in the decoder but also to the feature extractor in the encoder.

Furthermore, a side information extractor 110 for extracting a selection side information 114 associated with the core signal 100 is provided. In addition, a parameter generator 108 is connected to the feature extractor 104 via feature transmission line 112 and to the side information extractor 110 via selection side information 114. The parameter generator 108 is configured for generating a parametric representation for estimating a spectral range of the frequency enhanced audio signal not defined by the core signal. The parameter generator 108 is configured to provide a number of parametric representation alternatives in response to the features 112 and to select one of the parametric representation alternatives as the parametric representation in response to the selection side information 114. The decoder furthermore comprises a signal estimator 118 for estimating a frequency enhanced audio signal using the parametric representation selected by the selector, i.e., parametric representation 116.

Figure 2:
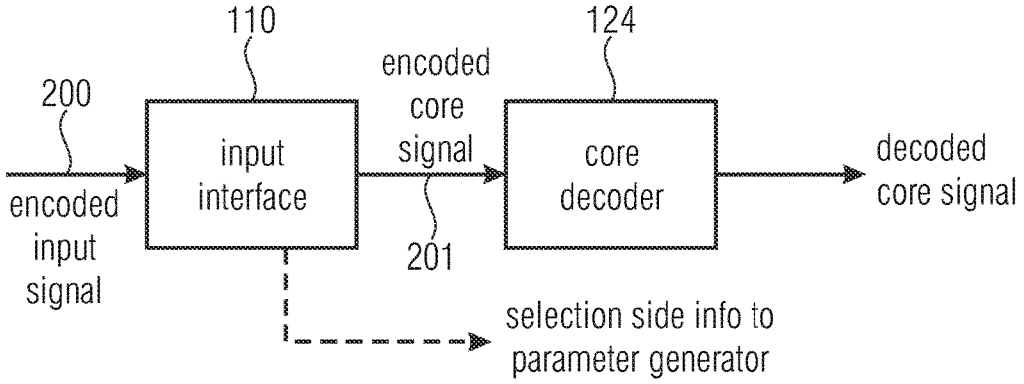
FIG. 2 illustrates a advantageous implementation in the context of the side information extractor of FIG. 1.

Particularly, the feature extractor 104 can be implemented to either extract from the decoded core signal as illustrated in FIG. 2. Then, an input interface 110 is configured for receiving an encoded input signal 200. This encoded input signal 200 is input into the interface 110 and the input interface 110 then separates the selection side information from the encoded core signal. Thus, the input interface 110 operates as the side information extractor 110 in FIG. 1. The encoded core signal 201 output by the input interface 110 is then input into a core decoder 124 to provide a decoded core signal which can be the core signal 100.

Alternatively, however, the feature extractor can also operate or extract a feature from the encoded core signal. Typically, the encoded core signal comprises a representation of scale factors for frequency bands or any other representation of audio information. Depending on the kind of feature extraction, the encoded representation of the audio signal is representative for the decoded core signal and, therefore features can be extracted. Alternatively or additionally, a feature can be extracted not only from a fully decoded core signal but also from a partly decoded core signal. In frequency domain coding, the encoded signal is representing a frequency domain representation comprising a sequence of spectral frames. The encoded core signal can, therefore, be only partly decoded to obtain a decoded representation of a sequence of spectral frames, before actually performing a spectrum-time conversion. Thus, the feature extractor 104 can extract features either from the encoded core signal or a partly decoded core signal or a fully decoded core signal. The feature extractor 104 can be implemented, with respect to its extracted features as known in the art and the feature extractor may, for example, be implemented as in audio fingerprinting or audio ID technologies.

Figures 3, 4:
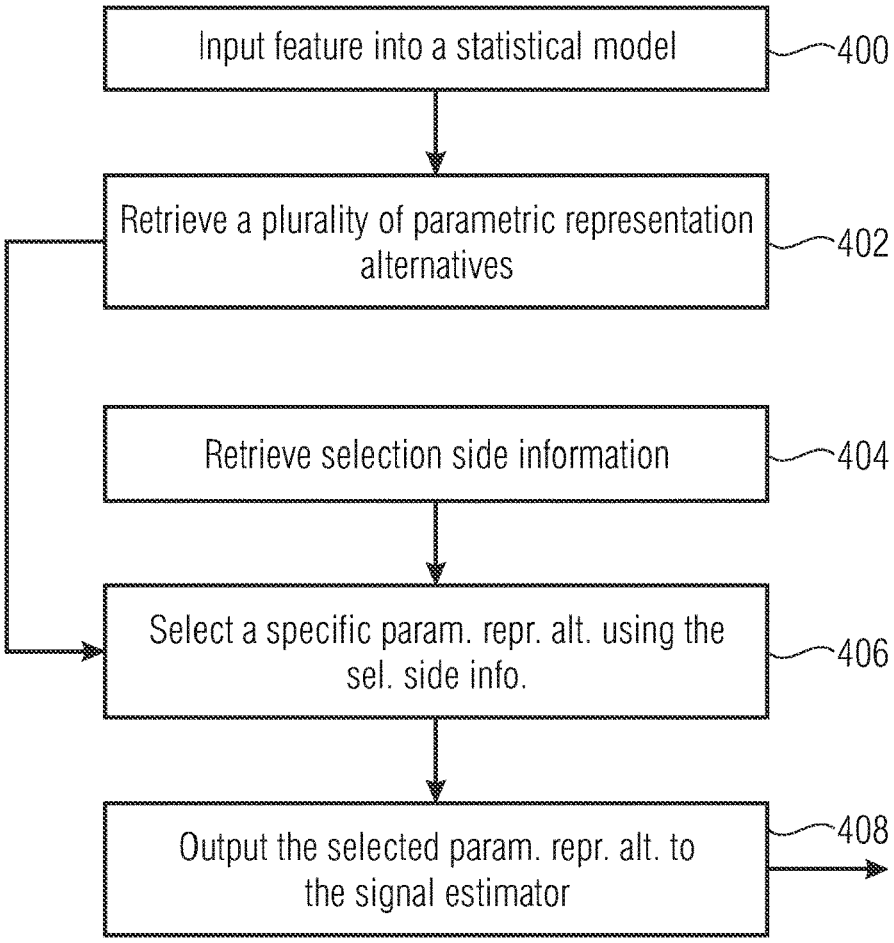
FIG. 3 illustrates a table relating to a number of bits of the selection side information to the number of parametric representation alternatives.
FIG. 4 illustrates a advantageous procedure performed in the parameter generator.

Advantageously, the selection side information 114 comprises a number N of bits per frame of the core signal. FIG. 3. Illustrates a table for different alternatives. The number of bits for the selection side information is either fixed or is selected depending on the number of parametric representation alternatives provided by a statistical model in response to an extracted feature. One bit of selection side information is sufficiently when only two parametric representation alternatives are provided by the statistical model in response to a feature. When a maximum number of four representation alternatives is provided by the statistical model, then two bits may be used for the selection side information. Three bits of selection side information allow a maximum of eight concurrent parametric representation alternatives. Four bits of selection side information actually allow 16 parametric representation alternatives and five bits of selection side information allow 32 concurrent parametric representation alternatives. It is advantageous to only use three or less than three bits of selection side information per frame resulting in a side information rate of 150 bits per second when a second is divided into 50 frames. This side information rate can even be reduced due to the fact that the selection side information may only be used when the statistical model actually provides representation alternatives. Thus, when the statistical model only provides a single alternative for a feature, then a selection side information bit is not necessary at all. On the other hand, when the statistical model only provides four parametric representation alternatives, then only two bits rather than three bits of selection side information may be used. Therefore, in typical cases, the additional side information rate can be even reduced below 150 bits per second.

Furthermore, the parameter generator is configured to provide, at the most, an amount of parametric representation alternatives being equal to $2^N$. On the other hand, when the parameter generator 108 provides, for example, only five parametric representation alternatives, then three bits of selection side information may nevertheless be used.

FIG. 4 illustrates a advantageous implementation of the parameter generator 108. Particularly, the parameter generator 108 is configured so that the feature 112 of FIG. 1 is input into a statistical model as outlined at step 400. Then, as outlined in step 402, a plurality of parametric representation alternatives are provided by the model.

Furthermore, the parameter generator 108 is configured for retrieving the selection side information 114 from the side information extractor as outlined in step 404. Then, in step 406, a specific parametric representation alternative is selected using the selection side information 114. Finally, in step 408, the selected parametric representation alternative is output to the signal estimator 118.

Figure 7:
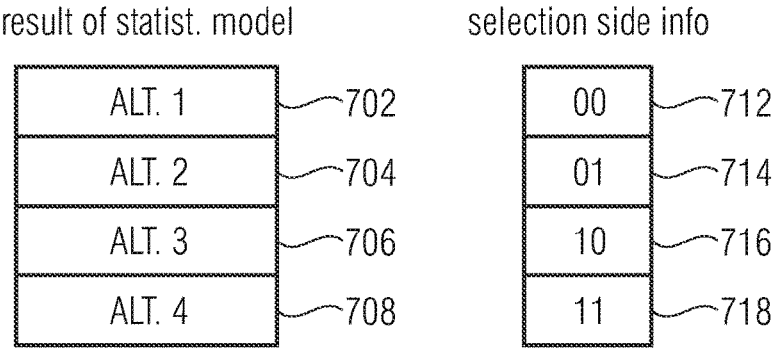
FIG. 7 illustrates an example for a result of a statistical model and the associated selection side information.

Advantageously, the parameter generator 108 is configured to use, when selecting one of the parametric representation alternatives, a predefined order of the parametric representation alternatives or, alternatively, an encoder-signal order of the representation alternatives. To this end, reference is made to FIG. 7. FIG. 7 illustrates a result of the statistical model providing four parametric representation alternatives 702, 704, 706, 708. The corresponding selection side information code is illustrated as well. Alternative 702 corresponds to bit pattern 712. Alternative 704 corresponds to bit pattern 714. Alternative 706 corresponds to bit pattern 716 and alternative 708 corresponds to bit pattern 718. Thus, when the parameter generator 108 or, for example, step 402 retrieves the four alternatives 702 to 708 in the order illustrated in FIG. 7, then a selection side information having bit pattern 716 will uniquely identify parametric representation alternative 3 (reference number 706) and the parameter generator 108 will then select this third alternative. When, however, the selection side information bit pattern is bit pattern 712, then the first alternative 702 would be selected.

The predefined order of the parametric representation alternatives can, therefore, be the order in which the statistical model actually delivers the alternatives in response to an extracted feature. Alternatively, if the individual alternative has associated different probabilities which are, however, quite close to each other, then the predefined order could be that the highest probability parametric representation comes first and so on. Alternatively, the order could be signaled for example by a single bit, but in order to even save this bit, a predefined order is advantageous.

Subsequently, reference is made to FIGS. 9 to 11.

Figure 9:
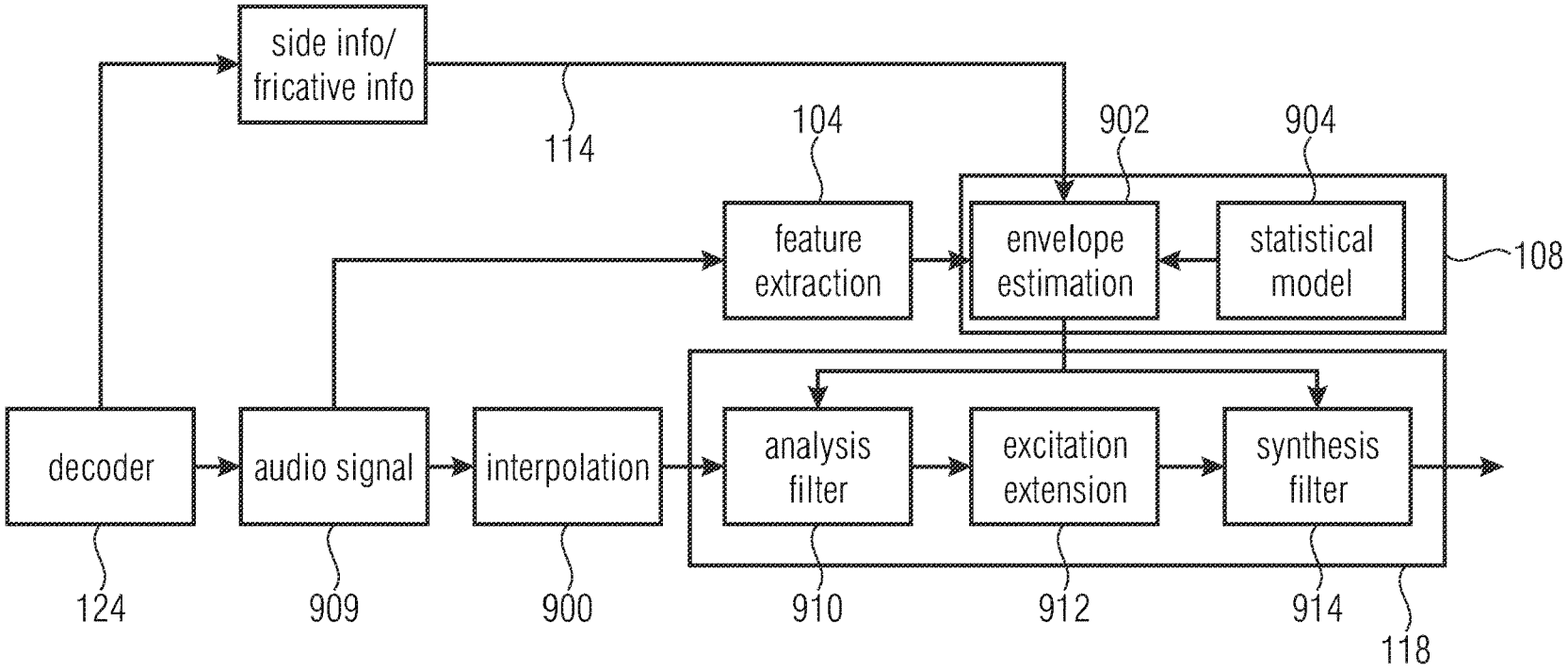
FIG. 9 illustrates a bandwidth extension signal processing scheme for an envelope estimation improvement.

In an embodiment according to FIG. 9, the invention is particularly suited for speech signals, as a dedicated speech source model is exploited for the parameter extraction. The invention is, however, not limited to speech coding. Different embodiments could employ other source models as well.

Particularly, the selection side information 114 is also termed to be a "fricative information", since this selection side information distinguishes between problematic sibilants or fricatives such as "f", "s" or "sh". Thus, the selection side information provides a clear definition of one of three problematic alternatives which are, for example, provided by the statistical model 904 in the process of the envelope estimation 902 which are both performed in the parameter generator 108. The envelope estimation results in a parametric representation of the spectral envelope of the spectral portions not included in the core signal.

Figure 15:
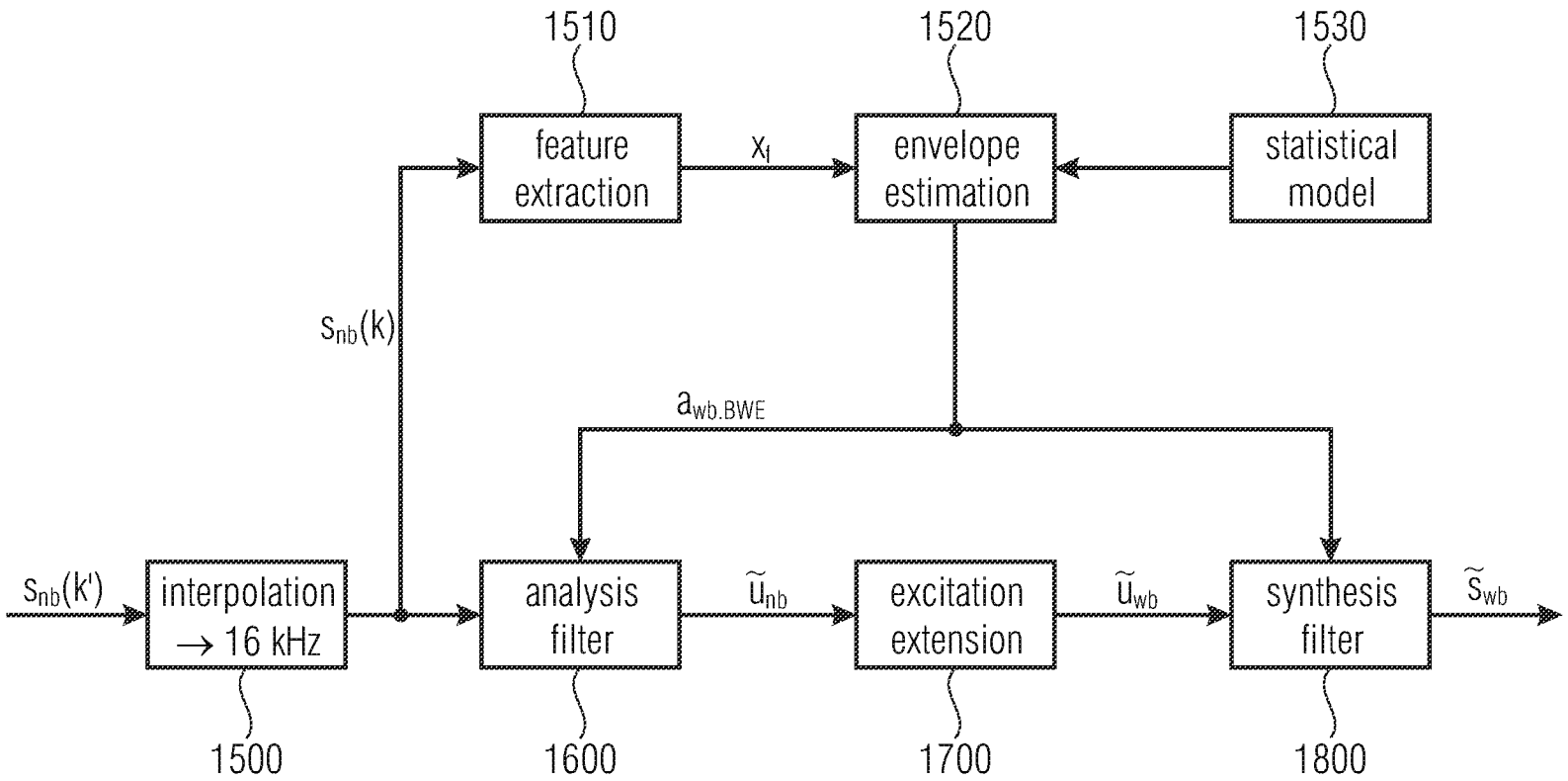
FIG 15 (PRIOR ART)
FIG. 15 illustrates a conventional-technology stand-alone bandwidth extension algorithm.
Figure 16:
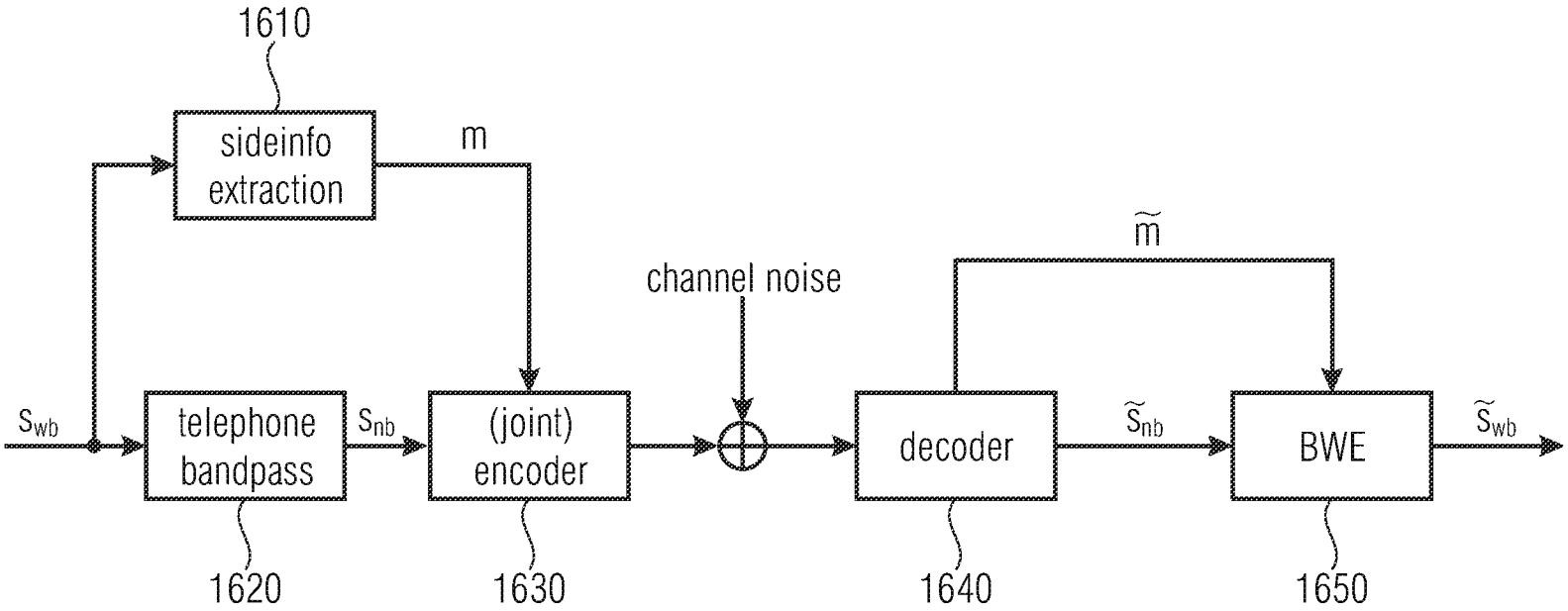
FIG 16 (PRIOR ART)
FIG. 16 illustrates an overview a transmission system with an addition message.

Block 104 can, therefore, correspond to block 1510 of FIG. 15. Furthermore, block 1530 of FIG. 15 may correspond to the statistical model 904 of FIG. 9.

Furthermore, it is advantageous that the signal estimator 118 comprises an analysis filter 910, an excitation extension block 112 and a synthesis filter 940. Thus, blocks 910, 912, 914 may correspond to blocks 1600, 1700 and 1800 of FIG. 15. Particularly, the analysis filter 910 is an LPC analysis filter. The envelope estimation block 902 controls the filter coefficients of the analysis filter 910 so that the result of block 910 is the filter excitation signal. This filter excitation signal is extended with respect to frequency in order to obtain an excitation signal at the output of block 912 which not only has the frequency range of the decoder 120 for an output signal but also has the frequency or spectral range not defined by the core coder and/or exceeding spectral range of the core signal. Thus, the audio signal 909 at the output of the decoder is upsampled and interpolated by an interpolator 900 and, then, the interpolated signal is subjected to the process in the signal estimator 118. Thus, the interpolator 900 in FIG. 9 may correspond to the interpolator 1500 of FIG. 15. Advantageously, however, in contrast to FIG. 15, the feature extraction 104 is performed using the non-interpolated signal rather than on the interpolated signal as illustrated in FIG. 15. This is advantageous in that the feature extractor 104 operates more efficient due to the fact that the non-interpolated audio signal 909 has a smaller number of samples compared to a certain time portion of the audio signal compared to the upsampled and interpolated signal at the output of block 900.

Figure 10:
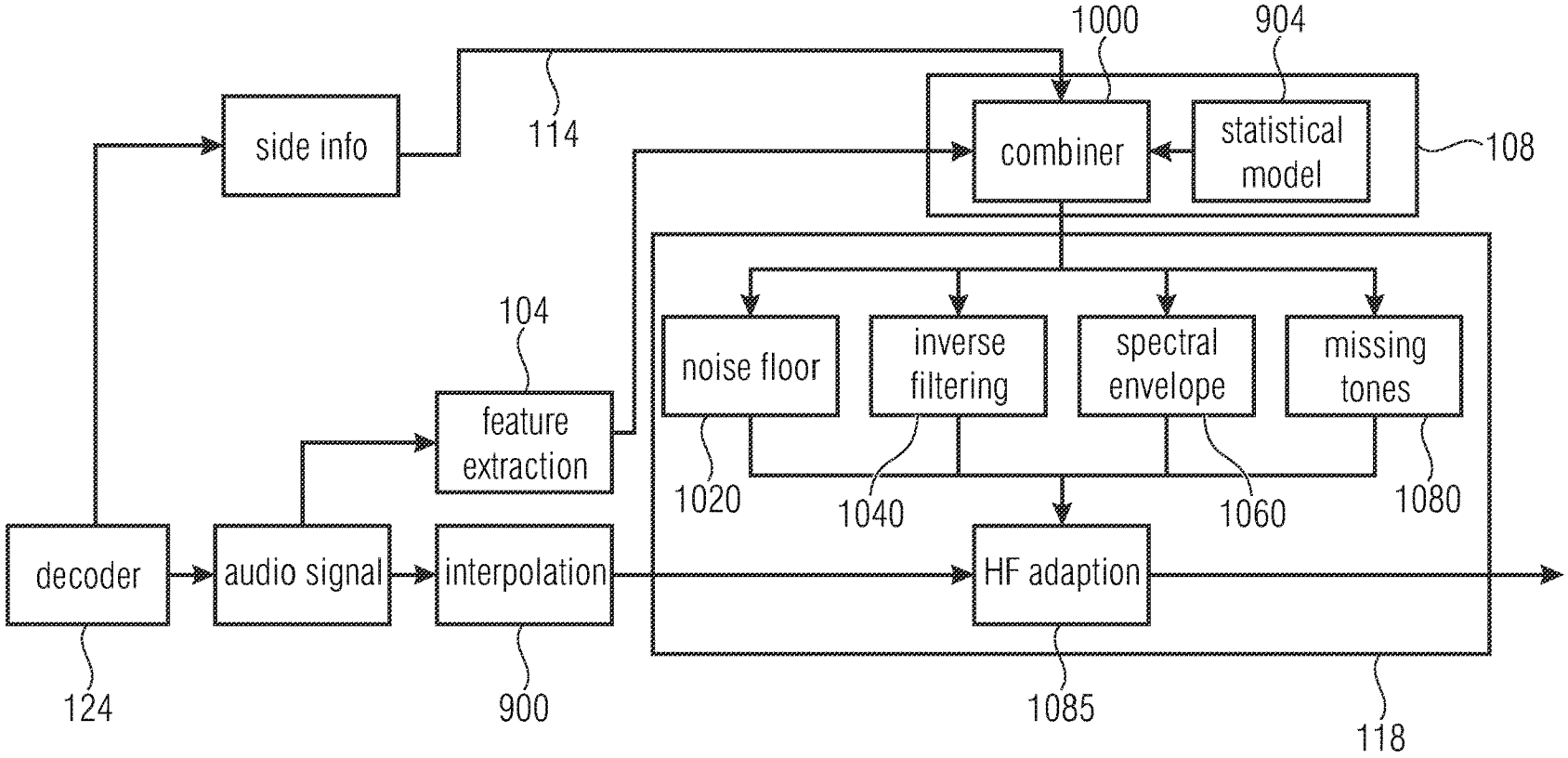
FIG. 10 illustrates a further implementation of a decoder in the context of spectral band replication procedures.

FIG. 10 illustrates a further embodiment of the present invention. In contrast to FIG. 9, FIG. 10 has a statistical model 904 not only providing an envelope estimate as in FIG. 9 but providing additional parametric representations comprising information for the generation of missing tones 1080 or the information for inverse filtering 1040 or information on a noise floor 1020 to be added. Blocks 1020, 1040, the spectral envelope generation 1060 and the missing tones 1080 procedures are described in the MPEG-4-Standard in the context of HE-AAC (High Efficiency Advanced Audio Coding).

Thus, other signals different from speech can also be coded as illustrated in FIG. 10. In that case, it might not be sufficient to code the spectral envelope 1060 alone, but also further side information such as tonality (1040), a noise level (1020) or missing sinusoids (1080) as done in the spectral band replication (SBR) technology illustrated in [6].

Figure 11:
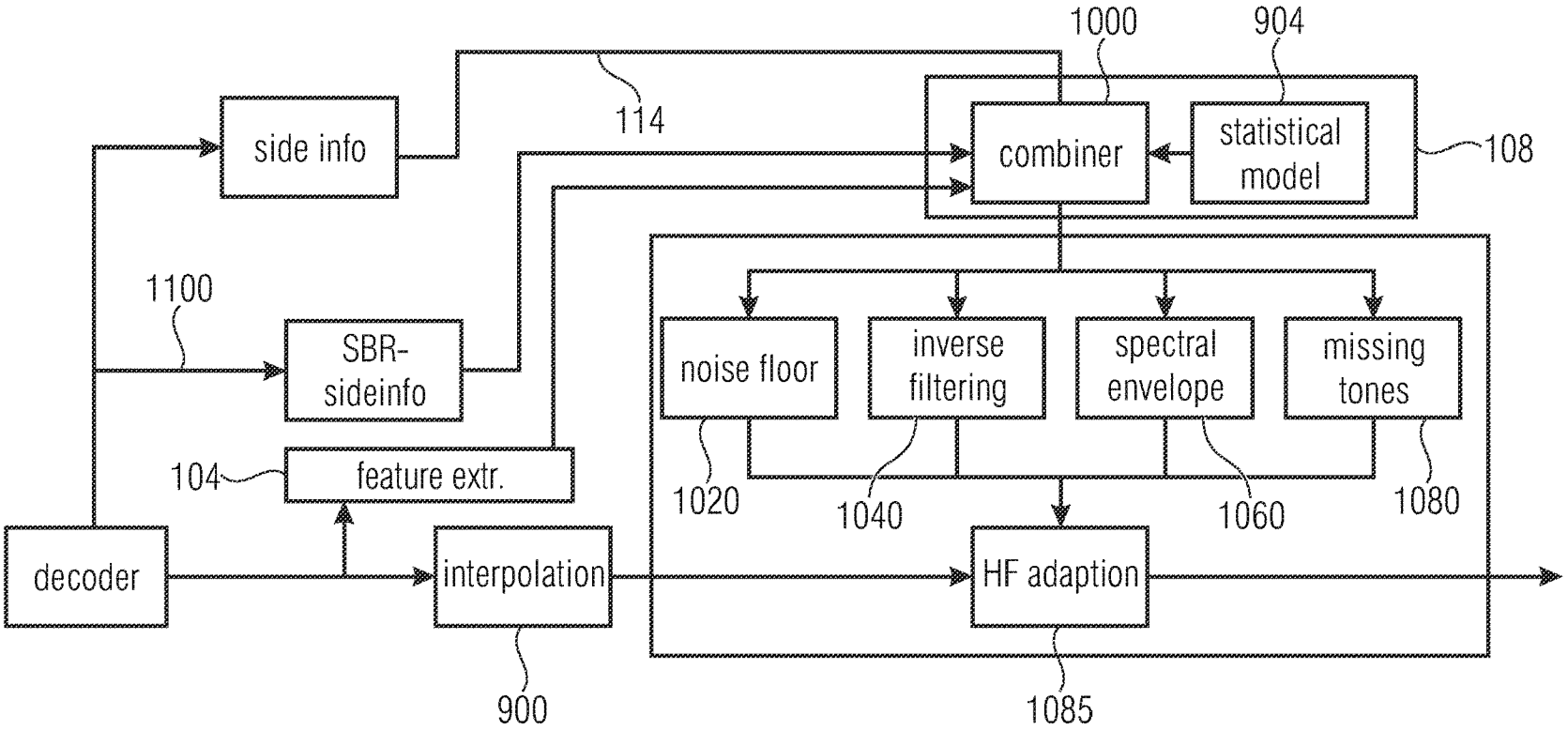
FIG. 11 illustrates a further embodiment of a decoder in the context of additionally transmitted side information.

A further embodiment is illustrated in FIG. 11, where the side information 114, i.e., the selection side information is used in addition to SBR side information illustrated at 1100. Thus, the selection side information comprising, for example, information regarding detected speech sounds is added to the legacy SBR side information 1100. This helps to more accurately regenerate the high frequency content for speech sounds such as sibilants including fricatives, plosives or vowels. Thus, the procedure illustrated in FIG. 11 has the advantage that the additionally transmitted selection side information 114 supports a decoder-side (phonem) classification in order to provide a decoder-side adaption of the SBR or BWE (bandwidth extension) parameters. Thus, in contrast to FIG. 10, the FIG. 11 embodiment provides, in addition to the selection side information the legacy SBR side information.

Figure 8:
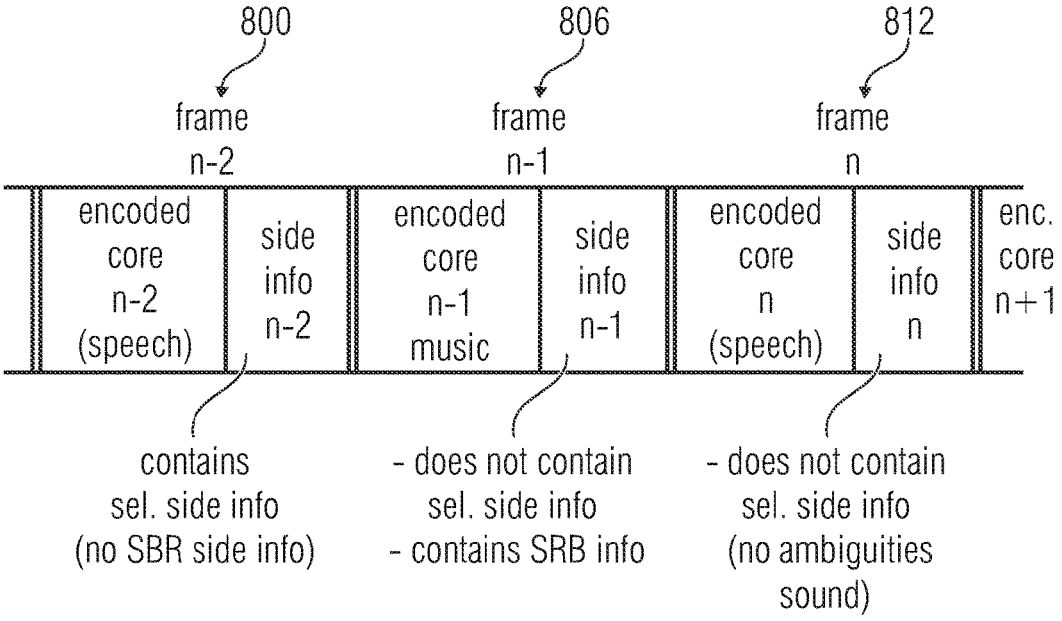
FIG. 8 illustrates an exemplary encoded signal comprising an encoded core signal and associated side information.

FIG. 8 illustrates an exemplary representation of the encoded input signal. The encoded input signal consists of subsequent frames 800, 806, 812. Each frame has the encoded core signal. Exemplarily, frame 800 has speech as the encoded core signal. Frame 806 has music as the encoded core signal and frame 812 again has speech as the encoded core signal. Frame 800 has, exemplarily, as the side information only the selection side information but no SBR side information. Thus, frame 800 corresponds to FIG. 9 or FIG. 10. Exemplarily, frame 806 comprises SBR information but does not contain any selection side information. Furthermore, frame 812 comprises an encoded speech signal and, in contrast to frame 800, frame 812 does not contain any selection side information. This is due to the fact that the selection side information are not necessary, since any ambiguities in the feature extraction/statistical model process have not been found on the encoder-side.

Figure 5:
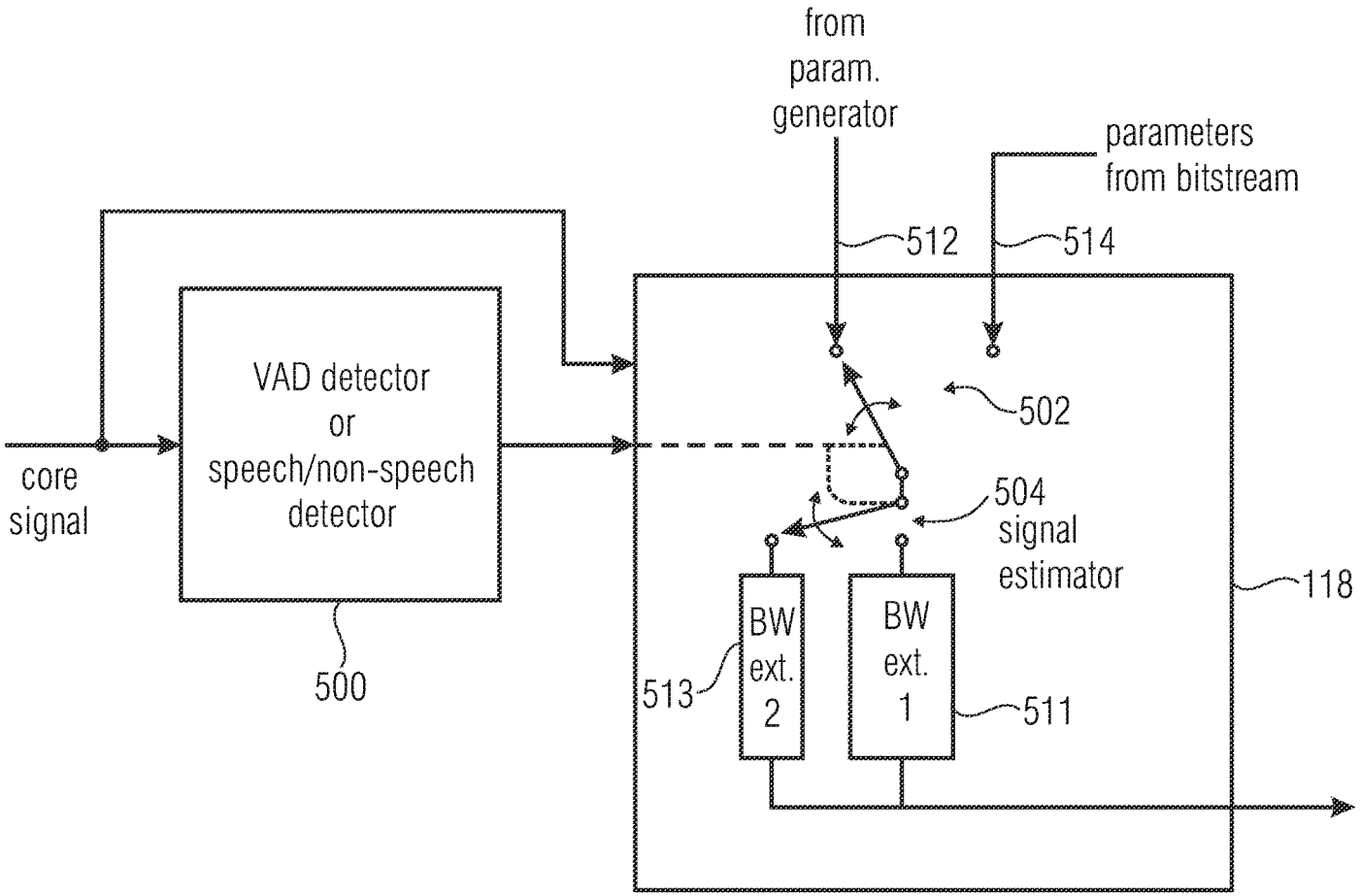
FIG. 5 illustrates a advantageous implementation of the signal estimator controlled by a voice activity detector or a speech/non-speech detector.

Subsequently, FIG. 5 is described. A voice activity detector or a speech/non-speech detector 500 operating on the core signal are employed in order to decide, whether the inventive bandwidth or frequency enhancement technology should be employed or a different bandwidth extension technology. Thus, when the voice activity detector or speech/non-speech detector detects voice or speech, then a first bandwidth extension technology BWEXT.1 illustrated at 511 is used which operates, for example as discussed in FIGS. 1, 9, 10, 11. Thus, switches 502, 504 are set in such a way that parameters from the parameter generator from input 512 are taken and switch 504 connects these parameters to block 511. When, however, a situation is detected by detector 500 which does not show any speech signals but, for example, shows music signals, then bandwidth extension parameters 514 from the bitstream are input advantageously into the other bandwidth extension technology procedure 513. Thus, the detector 500 detects, whether the inventive bandwidth extension technology 511 should be employed or not. For non-speech signals, the coder can switch to other bandwidth extension techniques illustrated by block 513 such as mentioned in [6, 8]. Hence, the signal estimator 118 of FIG. 5 is configured to switch over to a different bandwidth extension procedure and/or to use different parameters extracted from an encoded signal, when the detector 500 detects a non-voice activity or a non-speech signal. For this different bandwidth extension technology 513, the selection side information are advantageously not present in the bitstream and are also not used which is symbolized in FIG. 5 by setting off the switch 502 to input 514.

Figure 6:
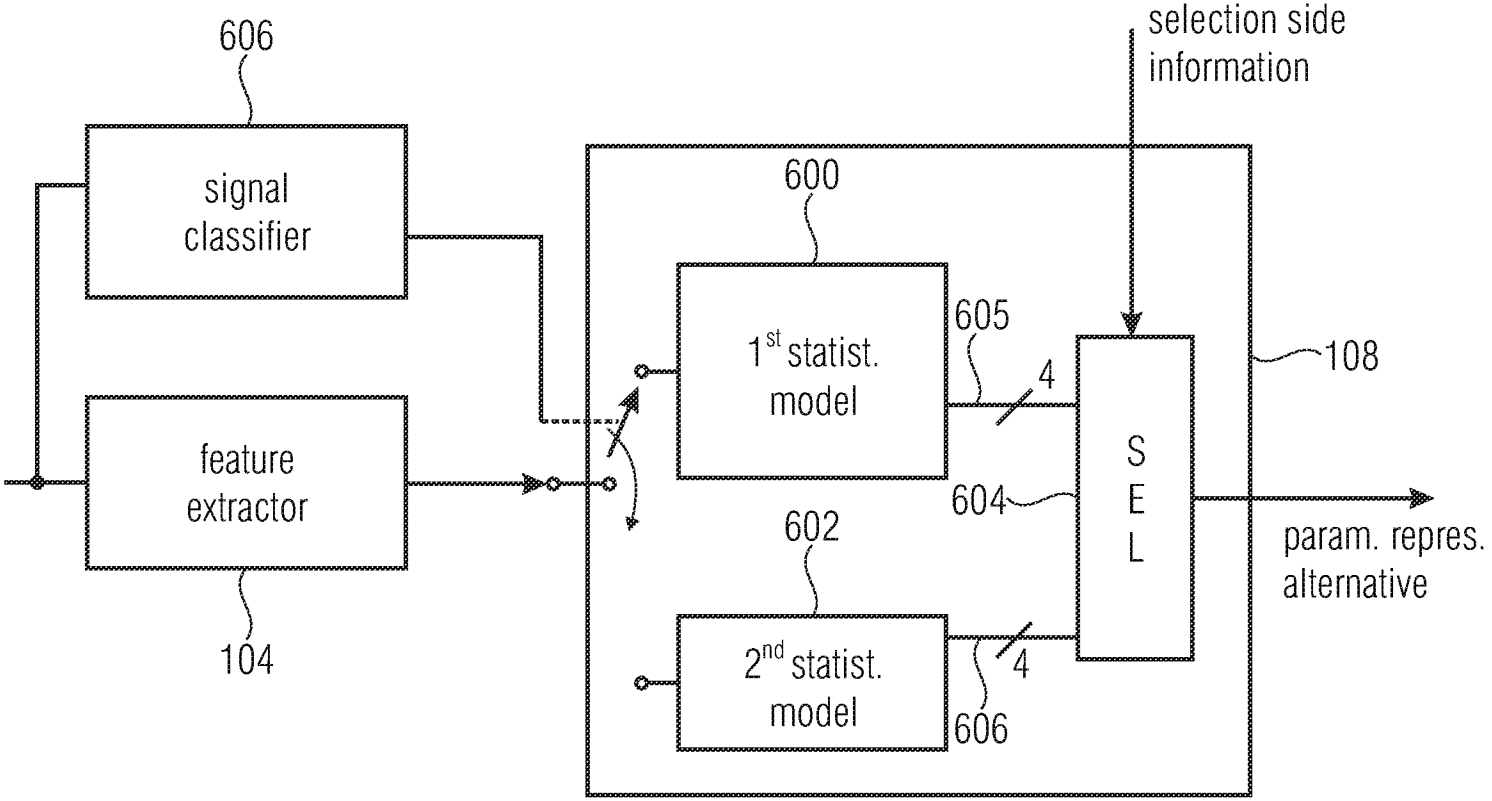
FIG. 6 illustrates a advantageous implementation of the parameter generator controlled by a signal classifier.

FIG. 6 illustrates a further implementation of the parameter generator 108. The parameter generator 108 advantageously has a plurality of statistical models such as a first statistical model 600 and a second statistical model 602. Furthermore, a selector 604 is provided which is controlled by the selection side information to provide the correct parametric representation alternative. Which statistical model is active is controlled by an additional signal classifier 606 receiving, at its input, the core signal, i.e., the same signal as input into the feature extractor 104. Thus, the statistical model in FIG. 10 or in any other Figures may vary with the coded content. For speech, a statistical model which represents a speech production source model is employed, while for other signals such as music signals as, for example, classified by the signal classifier 606 a different model is used which is trained upon a large musical dataset. Other statistical models are additionally useful for different languages etc.

As discussed before, FIG. 7 illustrates the plurality of alternatives as obtained by a statistical model such as statistical model 600. Therefore, the output of block 600 is, for example, for different alternatives as illustrated at parallel line 605. In the same way, the second statistical model 602 can also output a plurality of alternatives such as for alternatives as illustrated at line 606. Depending on the specific statistical model, it is advantageous that only alternatives having a quite high probability with respect to the feature extractor 104 are output. Thus, a statistical model provides, in response to a feature, a plurality of alternative parametric representations, wherein each alternative parametric representation has a probability being identical to the probabilities of other different alternative parametric representations or being different from the probabilities of other alternative parametric representations by less than 10%. Thus, in an embodiment, only the parametric representation having the highest probability and a number of other alternative parametric representations which all have a probability being only 10% smaller than the probability of the best matching alternative are output.

Figure 12:
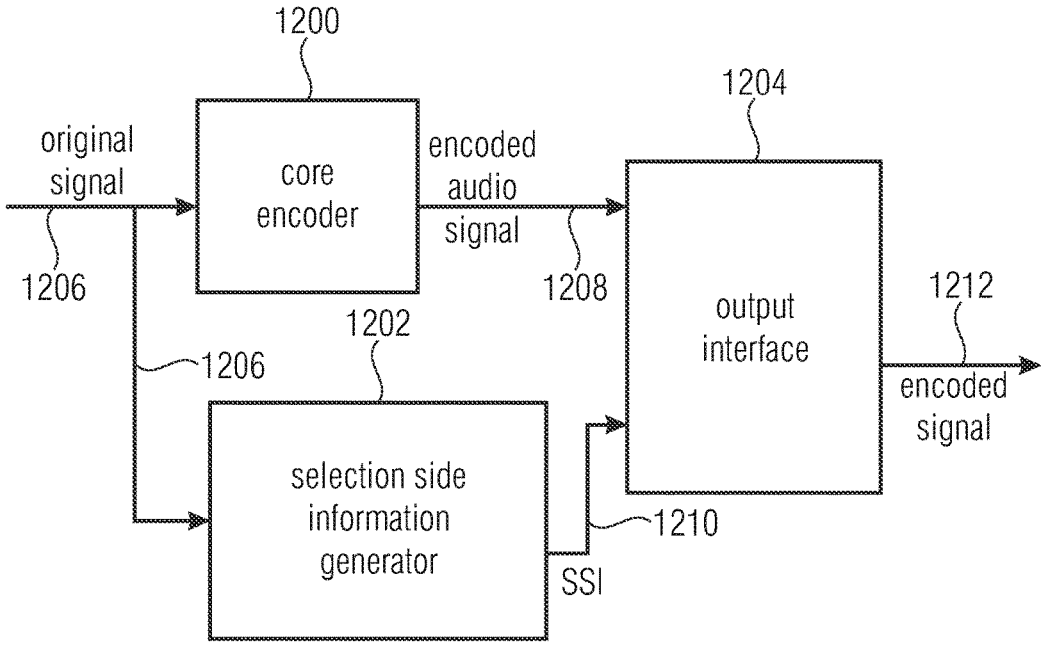
FIG. 12 illustrates an embodiment of an encoder for generating an encoded signal.
Figure 13:
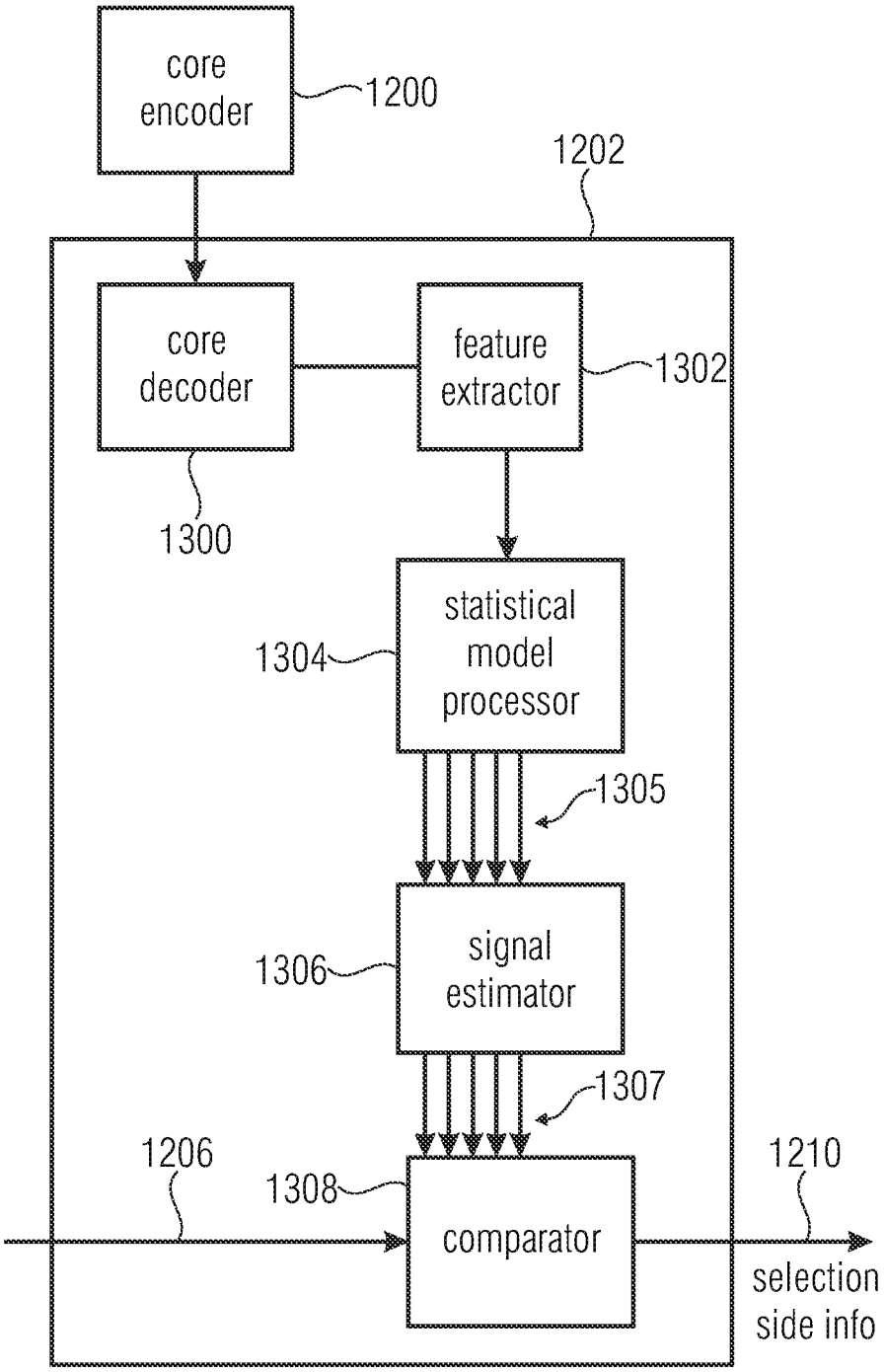
FIG. 13 illustrates an implementation of the selection side information generator of FIG. 12.

FIG. 12 illustrates an encoder for generating an encoded signal 1212. The encoder comprises a core encoder 1200 for encoding an original signal 1206 to obtain an encoded core audio signal 1208 having information on a smaller number of frequency bands compared to the original signal 1206. Furthermore, a selection side information generator 1202 for generating selection side information 1210 (SSI—selection side information) is provided. The selection side information 1210 indicate a defined parametric representation alternative provided by a statistical model in response to a feature extracted from the original signal 1206 or from the encoded audio signal 1208 or from a decoded version of the encoded audio signal. Furthermore, the encoder comprises an output interface 1204 for outputting the encoded signal 1212. The encoded signal 1212 comprises the encoded audio signal 1208 and the selection side information 1210. Advantageously, the selection side information generator 1202 is implemented as illustrated in FIG. 13. To this end, the selection side information generator 1202 comprises a core decoder 1300. The feature extractor 1302 is provided which operates on the decoded core signal output by block 1300. The feature is input into a statistical model processor 1304 for generating a number of parametric representation alternatives for estimating a spectral range of a frequency enhanced signal not defined by the decoded core signal output by block 1300. These parametric representation alternatives 1305 are all input into a signal estimator 1306 for estimating a frequency enhanced audio signal 1307. These estimated frequency enhanced audio signals 1307 are then input into a comparator 1308 for comparing the frequency enhanced audio signals 1307 to the original signal 1206 of FIG. 12. The selection side information generator 1202 is additionally configured to set the selection side information 1210 so that the selection side information uniquely defines the parametric representation alternative resulting in a frequency enhanced audio signal best matching with the original signal under an optimization criterion. The optimization criterion may be an MMSE (minimum means squared error) based criterion, a criterion minimizing the sample-wise difference or advantageously a psychoacoustic criterion minimizing the perceived distortion or any other optimization criterion known to those skilled in the art.

Figure 14:
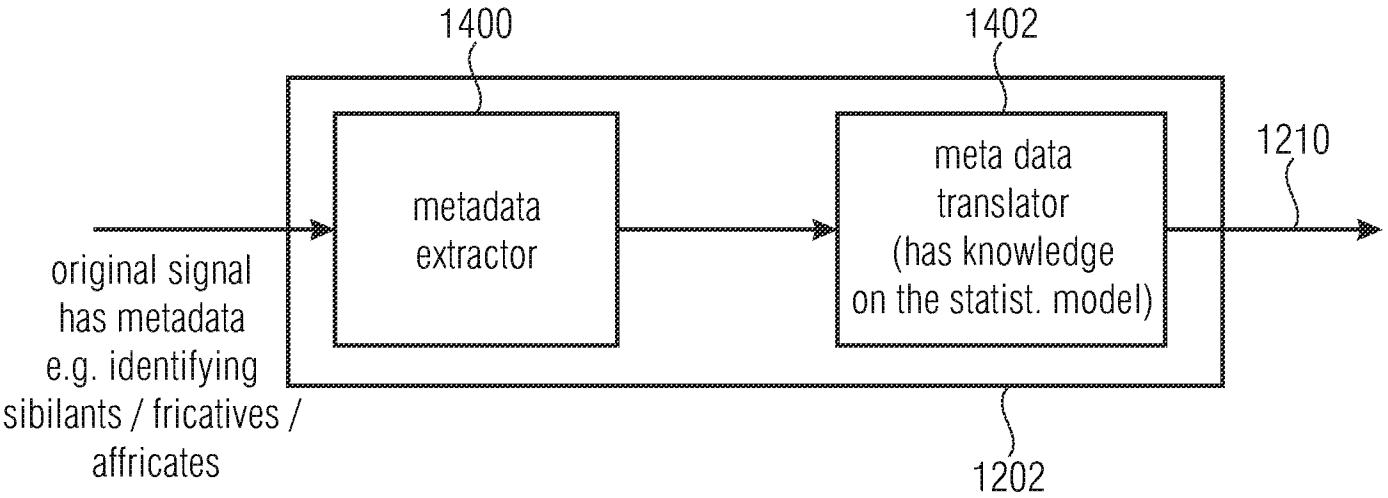
FIG. 14 illustrates a further implementation of the selection side information generator of FIG. 12.

While FIG. 13 illustrates a closed-loop or analysis-by-synthesis procedure, FIG. 14 illustrates an alternative implementation of the selection side information 1202 more similar to an open-loop procedure. In the FIG. 14 embodiment, the original signal 1206 comprises associated meta information for the selection side information generator 1202 describing a sequence of acoustical information (e.g. annotations) for a sequence of samples of the original audio signal. The selection side information generator 1202 comprises, in this embodiment, a metadata extractor 1400 for extracting the sequence of meta information and, additionally, a metadata translator, typically having knowledge on the statistical model used on the decoder-side for translating the sequence of meta information into a sequence of selection side information 1210 associated with the original audio signal. The metadata extracted by the metadata extractor 1400 is discarded in the encoder and is not transmitted in the encoded signal 1212. Instead, the selection side information 1210 is transmitted in the encoded signal together with the encoded audio signal 1208 generated by the core encoder which has a different frequency content and, typically, a smaller frequency content compared to the finally generated decoded signal or compared to the original signal 1206.

The selection side information 1210 generated by the selection side information generator 1202 can have any of the characteristics as discussed in the context of the earlier Figures.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive transmitted or encoded signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a non-transitory storage medium such as a digital storage medium, or a computer-readable medium) comprising, recorded thereon, the computer program for performing one of the methods described herein. The data carrier, the digital storage medium or the recorded medium are typically tangible and/or non-transitory.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] B. Bessette et al., "The Adaptive Multi-rate Wideband Speech Codec (AMR-WB)," *IEEE Trans. on Speech and Audio Processing*, Vol. 10, No. 8, November 2002.

[2] B. Geiser et al., "Bandwidth Extension for Hierarchical Speech and Audio Coding in ITU-T Rec. G.729.1," *IEEE Trans. on Audio, Speech, and Language Processing*, Vol. 15, No. 8, November 2007.

[3] B. Iser, W. Minker, and G. Schmidt, *Bandwidth Extension of Speech Signals*, Springer Lecture Notes in Electrical Engineering, Vol. 13, New York, 2008.

[4] M. Jelinek and R. Salami, "Wideband Speech Coding Advances in VMR-WB Standard," *IEEE Trans. on Audio, Speech, and Language Processing*, Vol. 15, No. 4, May 2007.

[5] I. Katsir, I. Cohen, and D. Malah, "Speech Bandwidth Extension Based on Speech Phonetic Content and Speaker Vocal Tract Shape Estimation," in *Proc. EUSIPCO* 2011, Barcelona, Spain, September 2011.

[6] E. Larsen and R. M. Aarts, *Audio Bandwidth Extension: Application of Psychoacoustics, Signal Processing and Loudspeaker Design*, Wiley, New York, 2004.

[7] J. Mäkinen et al., "AMR-WB+: A New Audio Coding Standard for 3rd Generation Mobile Audio Services," in *Proc. ICASSP* 2005, Philadelphia, USA, March 2005.

[8] M. Neuendorf et al., "MPEG Unified Speech and Audio Coding—The ISO/MPEG Standard for High-Efficiency Audio Coding of All Content Types," in *Proc.* 132$^{nd}$ *Convention of the AES*, Budapest, Hungary, April 2012. Also to appear in the Journal of the AES, 2013.

[9] H. Pulakka and P. Alku, "Bandwidth Extension of Telephone Speech Using a Neural Network and a Filter Bank Implementation for Highband Mel Spectrum," *IEEE Trans. on Audio, Speech, and Language Processing*, Vol. 19, No. 7, September 2011.

[10] T. Vaillancourt et al., "ITU-T EV-VBR: A Robust 8-32 kbit/s Scalable Coder for Error Prone Telecommunications Channels," in Proc. EUSIPCO 2008, Lausanne, Switzerland, August 2008.

[11] L. Miao et al., "G.711.1 Annex D and G.722 Annex B: New ITU-T Superwideband codecs," in Proc. ICASSP 2011, Prague, Czech Republic, May 2011.

[12] Bernd Geiser, Peter Jax, and Peter Vary: "ROBUST WIDEBAND ENHANCEMENT OF SPEECH BY COMBINED CODING AND ARTIFICIAL BANDWIDTH EXTENSION", Proceedings of International Workshop on Acoustic Echo and Noise Control (IWAENC), 2005

The invention claimed is:

1. An audio decoder for generating a frequency enhanced audio signal, comprising:

a feature extractor configured for extracting a feature from a core audio signal;

a side information extractor configured for extracting a selection side information associated with the core audio signal;

a parameter generator configured for generating a parametric representation for estimating a spectral range of the frequency enhanced audio signal not defined by the core audio signal, wherein the parameter generator is configured to provide a number of parametric representation alternatives in response to the feature, and wherein the parameter generator is configured to select one of the parametric representation alternatives as the parametric representation in response to the selection side information; and a signal estimator configured for estimating the frequency enhanced audio signal using the parametric representation selected, wherein the selection side information comprises a number N of bits per frame of the core audio signal, wherein the parameter generator is configured to provide, at the most, an amount of parametric representation alternatives being equal to $2^N$, wherein at least one of the feature extractor, the side information extractor, the parameter generator, and the signal estimator comprises a hardware implementation.

2. The audio decoder of claim 1, further comprising:

an input interface configured for receiving an encoded input signal comprising an encoded core audio signal and the selection side information; and a core decoder for decoding the encoded core audio signal to acquire the core audio signal.

3. The audio decoder of claim 1, wherein the parameter generator is configured to use, when selecting one of the parametric representation alternatives, a predefined order of the parametric representation alternatives or an encoder-signaled order of the parametric representation alternatives.

4. The audio decoder of claim 1, wherein the parameter generator is configured to provide an envelope representation as the parametric representation, wherein the selection side information indicates one of a plurality of different sibilants or fricatives, and wherein the parameter generator is configured for providing the envelope representation identified by the selection side information.

5. The audio decoder of claim 1, in which the signal estimator comprises an interpolator configured for interpolating the core audio signal, and wherein the feature extractor is configured to extract the feature from the core audio signal not being interpolated.

6. The audio decoder of claim 1, wherein the signal estimator comprises:

an analysis filter configured for analyzing the core audio signal or an interpolated core audio signal to acquire an excitation signal;

an excitation extension block configured for generating an enhanced excitation signal comprising the spectral range not comprised by the core audio signal; and a synthesis filter configured for filtering the extended excitation signal;

wherein the analysis filter or the synthesis filter are determined by the parametric representation selected.

7. The audio decoder of claim 1, wherein the signal estimator comprises a spectral bandwidth extension processor configured for generating an extended spectral band corresponding to the spectral range not comprised by the core audio signal using at least a spectral band of the core audio signal and the parametric representation, wherein the parametric representation comprises parameters for at least one of a spectral envelope adjustment, a noise floor addition, an inverse filter and an addition of missing tones, wherein the parameter generator is configured to provide, for a feature, a plurality of parametric representation alternatives, each parametric representation alternative comprising parameters for at least one of a spectral envelope adjustment, a noise floor addition, an inverse filtering, and addition of missing tones.

8. The audio decoder of claim 1, further comprising:

a voice activity detector or a speech/non-speech discriminator, wherein the signal estimator is configured to estimate the frequency enhanced signal using the parametric representation only when the voice activity detector or the speech/non-speech detector indicates a voice activity or a speech signal.

9. The audio decoder of claim 8, wherein the signal estimator is configured to switch from one frequency enhancement procedure to a different frequency enhancement procedure or to use different parameters extracted from an encoded signal, when the voice activity detector or speech/non-speech detector indicates a non-speech signal or a signal not comprising a voice activity.

10. The audio decoder of claim 1, wherein the statistical model is configured to provide, in response to a feature, a plurality of alternative of parametric representations, wherein each alternative parametric representation comprises a probability being identical to a probability of a different alternative parametric representation or being different from the probability of the alternative parametric representation by less than 10% of the highest probability.

11. The audio decoder of claim 1, wherein the selection side information is only comprised by a frame of the encoded signal, when the parameter generator provides a plurality of parametric representation alternatives, and wherein the selection side information is not comprised by a different frame of the encoded audio signal in which the parameter generator provides only a single parametric representation alternative in response to the feature.

12. An audio encoder for generating an encoded signal, comprising:

a core encoder configured for encoding an original signal to acquire an encoded audio signal comprising information on a smaller number of frequency bands compared to an original signal;

a selection side information generator configured for generating selection side information indicating a defined parametric representation alternative provided by a statistical model in response to a feature extracted from the original signal or from the encoded audio signal or from a decoded version of the encoded audio signal; and an output interface configured for outputting the encoded signal, the encoded signal comprising the encoded audio signal and the selection side information, wherein the selection side information generator is configured to generate a selection side information comprising a number N of bits per frame of the encoded audio signal, wherein the statistical model is so that, at the most, an amount of parametric representation alternatives being equal to $2^N$ is provided, wherein at least one of the core encoder, the selection side information generator, and the output interface comprises a hardware implementation.

13. The audio encoder of claim 12, wherein the output interface is configured to only comprise the selection side information into the encoded signal, when a plurality of parametric representation alternatives are provided by the statistical model and to not comprise any selection side information into a frame for the encoded audio signal, in which the statistical model is operative to only provide a single parametric representation in response to the feature.

14. An audio decoding method for generating a frequency enhanced audio signal, comprising:

extracting a feature from a core audio signal;

extracting a selection side information associated with the core audio signal;

generating a parametric representation for estimating a spectral range of the frequency enhanced audio signal not defined by the core audio signal, wherein a number of parametric representation alternatives is provided in response to the feature, and wherein one of the parametric representation alternatives is selected as the parametric representation in response to the selection side information; and estimating the frequency enhanced audio signal using the parametric representation selected, wherein the selection side information comprises a number N of bits per frame of the core audio signal, wherein the generating provides, at the most, an amount of parametric representation alternatives being equal to $2^N$, wherein one or more of the extracting a feature, extracting a selection side information, generating a parametric representation, and estimating the frequency enhanced audio signal is implemented, at least in part, by one or more hardware elements of an audio signal processing device.

15. An audio encoding method of generating an encoded signal, comprising:

encoding an original signal to acquire an encoded audio signal comprising information on a smaller number of frequency bands compared to an original signal;

generating selection side information indicating a defined parametric representation alternative provided by a statistical model in response to a feature extracted from the original signal or from the encoded audio signal or from a decoded version of the encoded audio signal; and outputting the encoded signal, the encoded signal comprising the encoded audio signal and the selection side information, wherein generating the selection side information comprises generating a selection side information comprising a number N of bits per frame of the encoded audio signal, wherein the statistical model is so that, at the most, an amount of parametric representation alternatives being equal to $2^N$ is provided, wherein one or more of the encoding an original signal, generating selection side information, and outputting the encoded signal is implemented, at least in part, by one or more hardware elements of an audio signal processing device.

16. A non-transitory storage medium having stored thereon a computer program for performing, when running on a computer or a processor, an audio decoding method for generating a frequency enhanced audio signal, the audio decoding method comprising:

extracting a feature from a core audio signal;

extracting a selection side information associated with the core audio signal;

generating a parametric representation for estimating a spectral range of the frequency enhanced audio signal not defined by the core audio signal, wherein a number of parametric representation alternatives is provided in response to the feature, and wherein one of the parametric representation alternatives is selected as the parametric representation in response to the selection side information; and estimating the frequency enhanced audio signal using the parametric representation selected, wherein the selection side information comprises a number N of bits per frame of the core audio signal, wherein the generating provides, at the most, an amount of parametric representation alternatives being equal to $2^N$.

17. A non-transitory storage medium having stored thereon a computer program for performing, when running on a computer or a processor, an audio encoding method of generating an encoded signal, the audio encoding method comprising:

encoding an original signal to acquire an encoded audio signal comprising information on a smaller number of frequency bands compared to an original signal;

generating selection side information indicating a defined parametric representation alternative provided by a statistical model in response to a feature extracted from the original signal or from the encoded audio signal or from a decoded version of the encoded audio signal; and outputting the encoded signal, the encoded signal comprising the encoded audio signal and the selection side information, wherein generating the selection side information comprises generating a selection side information comprising a number N of bits per frame of the encoded audio signal, wherein the statistical model is so that, at the most, an amount of parametric representation alternatives being equal to $2^N$ is provided.

* * * * *